United States Patent [19]

Weinerman et al.

[11] Patent Number: 4,674,780

[45] Date of Patent: Jun. 23, 1987

[54] SILL MOUNTED CONTROL BUTTON ASSEMBLY FOR A VEHICLE DOOR LOCK

[75] Inventors: Lee S. Weinerman, Medina; Joel T. Vargus, Middleburg Hts., both of Ohio

[73] Assignee: The Eastern Company, Strongsville, Ohio

[21] Appl. No.: 781,536

[22] Filed: Sep. 30, 1985

[51] Int. Cl.[4] ..... E05C 13/02

[52] U.S. Cl. ..... 292/336.3; 292/1; 74/531; 74/535

[58] Field of Search ..... 292/1, 336.3, 347, 17, 292/DIG. 37, 152; 74/531, 535, 538

[56] References Cited

U.S. PATENT DOCUMENTS

| | | | |
|---|---|---|---|
| 2,834,628 | 5/1958 | Paparelli et al. | 292/347 |
| 2,950,614 | 8/1960 | Evans | 292/347 X |
| 4.415,192 | 11/1983 | Kodama et al. | 292/336.3 X |

*Primary Examiner*—Richard E. Moore

*Attorney, Agent, or Firm*—David A. Burge

[57] ABSTRACT

A control button assembly for positioning an operating rod to "lock" and "unlock" a vehicle door lock includes a sleeve member and a button member. The button member has a hollow stem portion for threading onto an upper end region of the operating rod. The sleeve member is a tubular part that surrounds the stem of the button member. The sleeve member is mountable on a window sill of a vehicle door structure, with portions of the sleeve member extending through a sill opening to surround the threaded upper end region of the operating rod. The sleeve member has a plurality of integrally formed, resilient fingers that depend from the sill as they extend alongside the stem of the button. The fingers have inwardly turned tip portions that frictionally grip outer surface portions of the stem. The frictional grip of the fingers on the stem acts as a detent to assist in holding the button in its lowermost or "locked" position. When the button member is moved to its uppermost or "unlocked" position, the tip portions move radially inwardly to underlie and obstruct downward movement of the button member from its unlocked position. Inclined cam surfaces are provided on the tip portions to engage the bottom surface of the button stem and to flex the resilient fingers radially outwardly in response to forceful downward movement of the button member from its unlocked position toward its locked position.

12 Claims, 8 Drawing Figures

SILL MOUNTED CONTROL BUTTON ASSEMBLY FOR A VEHICLE DOOR LOCK

BACKGROUND OF THE INVENTION

1. Field of the Invention

The present invention relates generally to a control button assembly for positioning an operating rod of a vehicle door lock to "lock" and "unlock" a vehicle door, and more particularly, to a control button assembly that has a sill mounted sleeve member with resilient depending fingers that are biased radially inwardly to frictionally grip the elongate stem of an upstanding button member that is connected to an operating rod of a vehicle door lock, with the gripping action of the fingers on the button serving to strongly resist any tendency of the control button and the operating rod to shift from set positions due to vibration and other movements that are a normal consequence of vehicle operation.

2. PRIOR ART

It is customary to provide the door structures of vehicles such as automobiles, vans, trucks and the like with lock mechanisms of the type that can be locked and unlocked by shifting an operating rod that is housed within interior portions of the door. The operating rod typically extends substantially vertically within the door structure and has a threaded upper end region that projects through a sill opening that is formed in the door structure near the bottom level of a window opening that is defined by the door structure. An actuator button is normally threaded onto the upper end region of the operating rod and is used to manually move the operating rod to lock and unlock the door. Depressing the button to its lowermost or "locked" position causes the operating rod to set components of the lock mechanism in a locked configuration. Raising the button to its uppermost or "unlocked" position causes the operating rod to effect unlocking of the lock mechanism.

While the actions of many types of vehicle door lock mechanisms tend to provide a retaining or detenting function for maintaining an actuator button and its associated operating rod in their unlocked and/or locked positions, some vehicle door lock mechanisms do not provide a desirable degree of retaining or detenting action (i.e., some locks fail to securely and reliably hold their actuator buttons and their associated operating rods in set positions). Where the retaining or detenting action of a door lock is insufficient, the vehicle's operator may, upon occasion, believe that all of the vehicle's doors are locked when, in fact, one or more of the lock mechanisms actually may have vibrated to their unlocked positions thereby leaving the vehicle unsecured. Vice versa, the vehicle operator may have intended to leave a door momentarily unlocked, but may discover that his shutting the door has so vibrated the lock mechanism as to permit the actuator button and the operating rod to move under the influence of gravity to lock the door.

SUMMARY OF THE INVENTION

The present invention overcomes the foregoing and other drawbacks of the prior art by providing a sill mountable control button assembly that can be utilized as original equipment with a newly installed vehicle door lock, or can be used as a replacement with an existing vehicle door lock. The control button assembly includes a button member that is threadedly connectable to the upper end region of a vertically shiftable operating rod of a vehicle door locking mechanism, and a sleeve member that surrounds the button member and is fixedly attachable to a sill structure about the boundaries of a sill opening through which the upper end region of the operating rod projects.

In accordance with one feature of the present invention, the sleeve member is provided with a plurality of resilient fingers that depend into the interior of an associated vehicle door. The fingers have inwardly turned tip portions that press radially inwardly against outer surface portions of the button member to provide a frictional gripping action that resists unintended upward and downward movements of the button member relative to the sleeve member such as may tend to occur as the result of normal vibration and operation of the vehicle. However, normal operating force applied by an operator to the button member will overcome the movement-inhibiting detent action of the resilient fingers, and will cause the button member to shift as desired between its unlocked and locked positions.

In accordance with a further feature of the preferred practice of the present invention, the tip portions of the fingers of the sleeve member move radially inwardly to slip beneath the lower end region of the button member when the button member is in its raised or unlocked position, whereby the tip portions serve to physically obstruct downward movement of the button member, thereby helping to assure that the button member will be prevented from accidentally moving downwardly to its locked position in response vibration caused by the closing of the vehicle's door or other force resulting from normal vehicle operation.

In accordance with still another feature, inclined cam surfaces are provided on the tip portions to engage the bottom wall of the button stem and to flex the resilient fingers radially outwardly in response to forceful downward movement of the button member from its raised, unlocked position.

As will be apparent from the foregoing summary, the present invention provides a control button assembly having button and sleeve members that interact advantageously to assure that a door lock operating rod will function in response to deliberate direct applications of operating force to move between locked and unlocked positions without unintentionally moving from set positions in response to vibrations and forces that are incurred during normal operation of a vehicle. The detenting action provided by control button assemblies that incorporate features of the present invention can be used to provide added movement restraints for lock operating rods that are insufficiently restrained by their associated locks, or as safety "backup" detents for lock systems that normally do not require detent augmentation.

BRIEF DESCRIPTION OF THE DRAWINGS

The foregoing and other advantages, and a fuller understanding of the invention that is described and claimed in the present application may be had by referring to the following description and claims taken in conjunction with the accompanying drawings wherein:

DESCRIPTION OF THE PREFERRED EMBODIMENT

Figure 1:
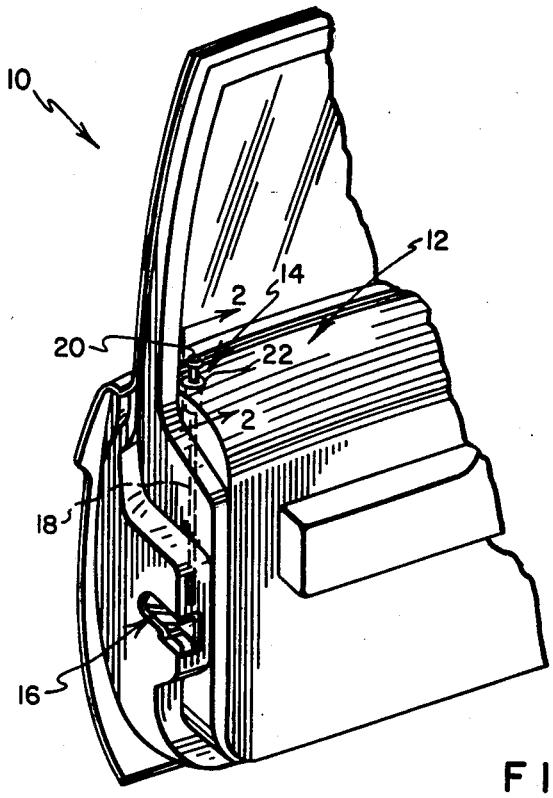
FIG. 1 is a perspective view of portions of a vehicle door as viewed from the interior, showing a sill mounted control button assembly embodying the preferred practice of the present invention in place on the door, and showing, in phantom, hidden portions of the control button assembly and a lock operating rod that connects with the button assembly.
Figure 2:
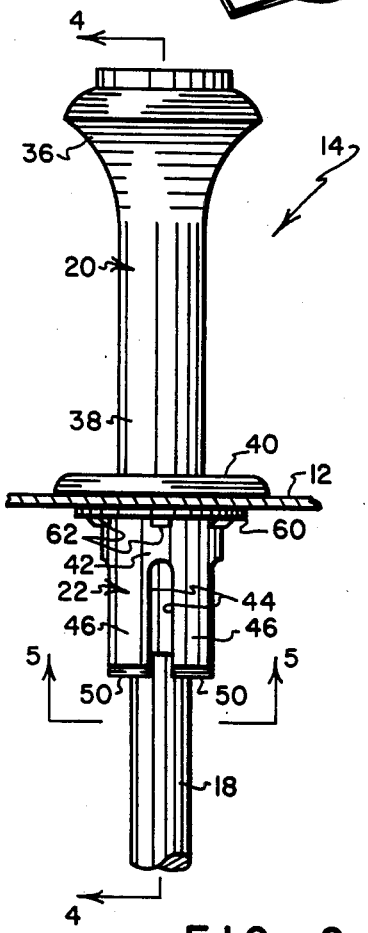
FIG. 2 is a sectional view on an enlarged scale of a sill portion of the vehicle door, as seen from a plane indicated by a line 2—2 in FIG. 1, and showing the control button and an upper end region of the operating rod in their extended or "unlocked" position.

Referring to FIG. 1 a vehicle door 10 is shown having a window sill 12. A control button assembly 14 that embodies the preferred practice of the present invention, is mounted in an opening (indicated by the numeral 32 in FIG. 8) that is formed through the sill 12 A conventional door lock mechanism, portions of which are indicated generally by the numeral 16, is carried by the door 10. An operating rod 18 (shown in phantom in FIG. 1) extends substantially vertically at a location housed within the door 10 and interconnects the control button assembly 14 and the door lock mechanism 16. The primary purpose of the control button assembly 14 is to provide a means for vertically shifting and positioning the operating rod 18 to control the operation of the door lock mechanism 16 to lock and unlock the door 10.

Referring to FIGS. 2 through 8, the control button assembly 14 includes a button member 20 and a sleeve member 22. The button member 20 is an elongate upstanding structure, lower portions of which are surrounded by the sleeve member 22. The sleeve member 22 is installed rigidly on the sill 12 to slidably receive the upper end region of the operating rod 18, as will be explained in greater detail. The button member 20 is connected to the upper end region of the operating rod 18 and is movable vertically within the sleeve member 22 between a raised or "unlocked" position, and a lowered or "locked" position, as will be explained.

Figure 3:
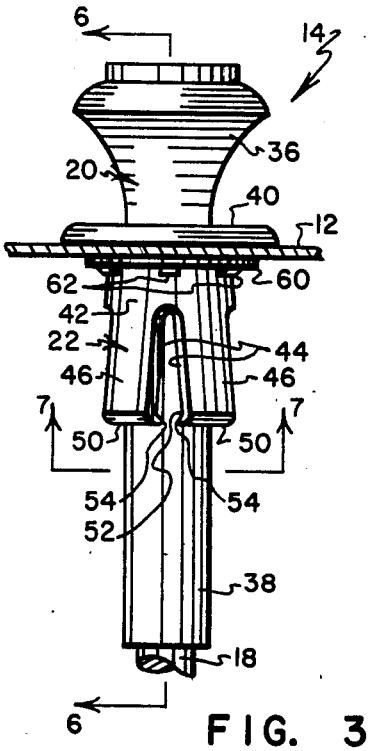
FIG. 3 is a view similar to FIG. 2, but showing the control button and the operating rod in their depressed or "locked" position.
Figure 6:
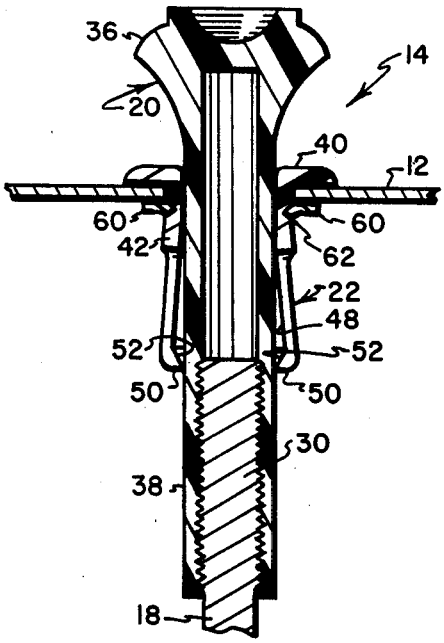
FIG. 6 is a sectional view as seen from a plane indicated by a line 6—6 in FIG. 3.
Figure 7:
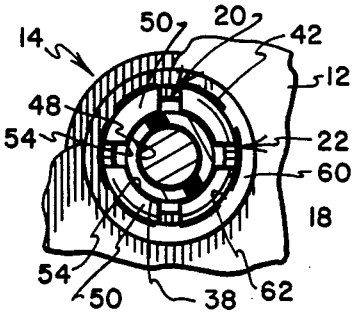
FIG. 7 is a sectional view as seen from a plane indicated by a line 7—7 in FIG. 3; and, FIG. 8 is an exploded perspective view of the components of the sill mounted control button assembly together with a portion of the sill, a conventional retaining washer, and the upper end region of the door lock operating rod.

In operation, the sill button assembly 14 functions in a primary capacity to control the door lock 16 in a conventional way in that, (1) depressing the button member 20 from its raised or "unlocked" position (as is depicted in FIGS. 1, 2, 4 and 5) to its or "locked" position (as is depicted in FIGS. 3, 6 and 7) causes the operating rod 18 to lock the door 10, while (2) raising the button member 20 from its or "locked" position to its raised or "unlocked" position causes the operating rod 18 to unlock the door 10.

A secondary feature, function and purpose of the sill mounted control button assembly 14 of the present invention is that it operates quite effectively to assist the normal action of the door lock mechanism 16 in retaining the button member 20 and the operating rod 18 in their locked and unlocked positions so as to inhibit unintended movements of the button member 20 and the operating rod 18 that might result in the undesired locking or unlocking of the door 10. In certain designs of conventional vehicle door locking mechanisms 16, it has been found that the door lock mechanism itself does not function to the desired degree or extent to retain or detent the set positions of the button member 20 and the operating rod 18. In view of the inadequate detenting or retaining action of such door lock mechanisms, it is possible that the button member 20 and the attached operating rod 18 may, due to vibration or other movements that are associated with normal vehicle operation, shift from their set positions. A control button assembly embodying features of the present invention can be used to augment the operation of such locks to overcome the described deficiency by providing an improved assembly including the button member 20 and sleeve member 22 wherein the members 20, 22 cooperate to assist in retaining the button member 20 and the operating rod 18 in set positions, typically their locked and unlocked positions.

Figure 4:
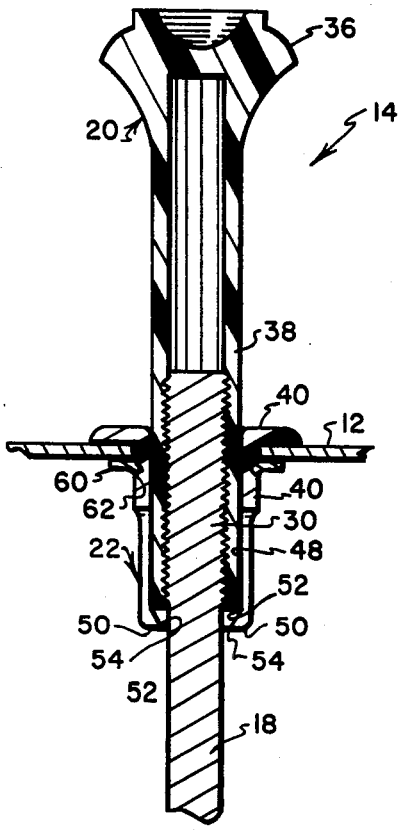
FIG. 4 is a sectional view as seen from a plane indicated by a line 4—4 in FIG. 2.
Figure 5:
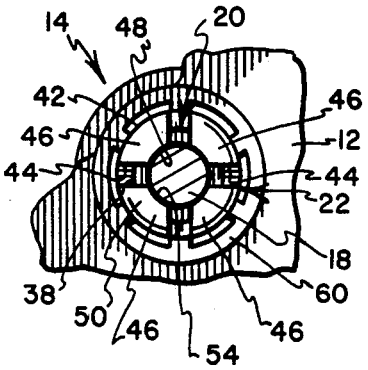
FIG. 5 is a sectional view as seen from a plane indicated by a line 5—5 in FIG. 2.
Figure 8:
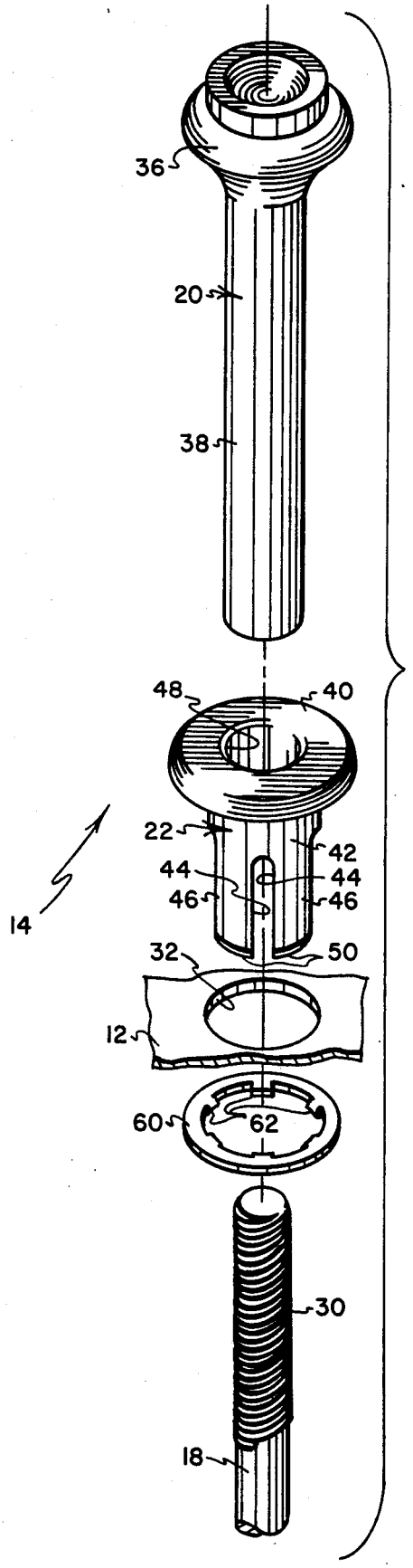

Turning now to a more detailed description, and referring to FIGS. 4, 6 and 8, the conventional lock operating rod 18 has a threaded upper end region 30 that is normally provided to make a firm connection with a conventional actuator button (not shown). The threaded upper end region 30 projects through an opening 32 that is defined by the sill 12 and normally threadedly connects with a conventional actuator button. As those skilled in the art are aware, a "conventional actuator button" typically has a shape that resembles the appearance of the button member 20, i.e., it has a rounded head 36 near its upper end region, and a depending stem 38 of generally cylindrical form near its lower end region. The stem 38 is hollow such that a downwardly opening hole 39 extends coaxially through much if not all of the depending stem 38. In the case of a conventional actuator button, its stem is sized to permit the actuator button to move freely within the opening 32 to effect locking and unlocking movements of the operating rod 18.

The button member 20 preferably is formed by injection molding from a plastics material that forms a rigid structure, such as a rigid thermosetting nylon, or high density polystyrene or the like. The sleeve member 22 preferably is formed by injection molding from a suitable thermosetting plastics material that forms a relatively stiff but nonetheless resilient structure, one such substance being a nylon material sold by E. I. DuPont deNemours & Company of Wilmington, De., under the trademark ZYTEL.

The sleeve member 22 is installed in the sill opening 32 and is held in place by a retaining washer 60, or by some other suitable conventional retaining means (not shown). The sleeve member 22 defines a washer-like top flange 40 that concentrically surrounds a center passage 48. The flange 40 rests upon the upper surface of the sill 12. The sleeve 22 also includes a depending cylindrical body portion 42 that defines a continuation of the center passage 48. The body portion 42 has side wall portions that are slotted, as indicated by numerals 44, to provide a plurality of integrally formed, depending, resilient fingers 46. The fingers 46 have inwardly turned tip portions 50. The tip portions 50 have inclined camming surfaces 52 (see FIGS. 3, 4 and 6) that face inwardly and upwardly. The camming surfaces 52 cooperate with bottom walls of the tip portions 50 to define pointed inner edges 54. The tip portions 50 are biased radially inwardly toward the operating rod 18 by the normal resilience of the material from which the sleeve member 22 is formed. When the sleeve member 22 is formed, the depending wall portions that define the fingers 46 preferably are molded so that they incline slightly inwardly as they extend downwardly away from the mounting flange 40 so that the fingers 46 normally tend to incline slightly inwardly (and hence tend to be biased inwardly when they are deflected outwardly).

The shank 30 of the button member 20 extends into the center passage 48 of the sleeve member 22. When the button member 20 is in its raised or unlocked position, as is shown in FIG. 4, the tip portions 50 underlie the lower end of the stem 38 of the button member 20 and thereby offer a substantial resistance to accidental lowering of the button member 20 from its raised or unlocked position as by vibration or the like. Because the button member 20 is threaded onto the upper end region 30 of the operating rod 18, the exact axial positioning of the button member 20 on the threaded end region 30 of the operating rod 18 can be adjusted so that, when the button member 20 is in its raised or unlocked position, the tip portions 50 closely underlie the lower end region of the stem 38 of the button member 20 and thereby serve to obstruct downward movement of the button member 20 from its unlocked position.

The hole 39 that is formed in the stem 38 of the button member 20 is sized such that the threaded connection which is established between the button member 20 and the operating rod 18 is quite snug and thereby serves to securely retain the position of the button member 20 in place on the threaded end region 30 of the operating rod 18. The hole 39 in the stem 38 is small enough to cause the male threads that are provided on the upper end region 30 of the operating rod 18 to cut corresponding female threads into the material of the stem 38 of the button member 20 as the button member 20 is threaded onto the upper end region 30, thus providing an inherently snug connection.

When the button member 20 is pushed downwardly to move the operating rod 18 to its locked position, as is depicted in FIG. 6, the engagement of the lower end region of the stem 38 with the inclined camming surfaces 52 causes the resilient fingers 46 to be deflected radially outwardly to a degree that is sufficient to permit the inner edges 54 of the tip portions 50 to slide along the outer wall of the stem 38 so that the inner edges 54 exert a significant degree of inwardly directed gripping force on the outer surface of the stem 38.

The cam surfaces 54 that are provided on the tip portions 50 are inclined with respect to the substantially vertical axis of movement of the operating rod 18, and cause downward force applied to the button member 20 (when the button member 20 is in its raised, unlocked position such that the bottom of the stem 38 engages the inclined cam surfaces 52) to be transformed into axial and radial components, with the radial components serving to deflect the tip portions 50 of the fingers 46 radially outwardly to positions wherein the tip portions 50 permit the stem 38 to pass and move downwardly (with the tip edge portions 54 being biased radially inwardly, and frictionally gripping the outer surface of the stem 38). Thus, the sleeve member 22 functions to frictionally grip the button member 20 and thereby to resist the possibility of the button member 20 vibrating to its raised or unlocked position.

The control button assembly 14 of the present invention can be designed to replace a conventional actuator button as by mounting the sleeve member 22 within the same sill opening 32 as is normally occupied by a conventional actuator button. Where a conventional actuator button is to be replaced, the sleeve member 22 is installed in the sill opening 32 about the threaded upper end region 30 of an operating rod 18, with the flange 40 of the sleeve member 22 positioned to rest upon the upper face of the sill 12. The body 42 of the sleeve member 22 is preferably locked in place by means of some suitable commercially available mounting device such as a toothed washer 60 which has teeth 62 that project inwardly and downwardly. The washer 60 is slipped over the lower end region of the body 42 of the sleeve 22 and is forced upwardly along the body 42 to a position wherein the washer 60 engages the lower surface of the sill 12, with the teeth 62 biting into the material of the body portion 42 of the sleeve 22 and thereby locking the sleeve 22 in place, as is best seen in FIGS. 4 and 6. The button member 20 is then threaded onto the upper end region 30 of the operating rod 18 to assume its proper position and to function as has been described and illustrated.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed.

What is claimed is:

1. In the environment of a vehicle door of the type typically having a window sill with a sill opening formed therethrough, a lock mechanism carried by the door at a location below the window sill, and a generally vertically movable operating rod for translation along a substantially vertical path of movement between unlocked and locked positions to unlock and lock the lock mechanism, wherein the operating rod has a threaded upper end region that extends along a portion of the path of movement and aligns with the sill opening, the improvement of a control button assembly, comprising:

(a) button means having elongate hollow shank means for receiving the upper end region of the operating rod therein and for threadedly connecting with the upper end region of the operating rod for moving the operating rod along the path of movement and for positioning the operating rod in its unlocked and locked positions;

(b) sleeve means having formation means for mounting the sleeve means on the window sill, and having resilient finger means including a plurality of elongate fingers for surrounding the shank means and being urged inwardly towards the shank means to exert pressure thereon for frictionally gripping the shank means to inhibit relative movement between the button means and the sleeve means; and, (c) whereby the button means and the sleeve means cooperate to provide a control button assembly for shifting and positioning the operating rod, and to provide a retaining function for inhibiting movement of the operating rod from set positions.

2. The apparatus of claim 1 wherein the formation means includes flange means formed as an integral part of the sleeve means for resting on the window sill, and wherein the fingers depend from the vicinity of the flange means and are formed integrally therewith.

3. The apparatus of claim 2 wherein the sleeve means is formed as a one piece part that is molded from plastics material, with the flange means and the fingers extending substantially concentrically about an imaginary center axis, with the flange means extending substantially in a plane that is perpendicular to the center axis, and with the fingers extending axially alongside the center axis, and with the finger means having inwardly turned tip means that project radially inwardly toward the center axis for engaging the shank means when the button means is other than in its unlocked position, and for underlying and obstructing movement of the shank means when the button means is in its unlocked position.

4. The apparatus of claim 3 additionally including cam surface means formed on the finger means for engaging the shank means when the button means is moved downwardly along the path of movement from its unlocked position to cause the tip means to move radially outwardly to permit movement of the shank means along the path of travel toward its locked position.

5. The apparatus of claim 1 wherein:

(a) the shank portion of the button means has lower and upper ends, and has a bottom wall at its lower end; and, (b) the fingers carry inwardly turned, integrally formed tip portions that surround and extend radially inwardly toward the shank means when the button means is out of its unlocked position, and that underlie the bottom wall and obstruct downward movement of the button means when the button means is in its unlocked position.

6. The apparatus of claim 5 additionally including means forming an adjustable threaded connection between the shank means and the operating rod to enable the relative axial position of the button means on the operating rod to be adjusted so that the tip portions will closely underlie the bottom wall when the button means is in its unlocked position.

7. A control button assembly for attachment to the upper end region of a vertically movable lock operating rod that is aligned with an opening formed in a window sill of a vehicle door, the assembly comprising:

(a) button means having threaded stem means for threadedly connecting with an upper end region of a lock operating rod that is aligned with an opening formed in a window sill of a vehicle door; and, (b) sleeve means for extending perimetrically about selected portions of the button means to slidably receive the button means, and having a flange for resting on said window sill, the sleeve means also having a body means for depending from the flange through said window sill opening, with the body means including integrally formed finger means for surrounding portions of the stem means and for frictionally gripping said portions to resist vertical movement of the button means relative to the sleeve means.

8. The control button assembly of claim 7 wherein:

(a) the stem means has lower and upper ends, and has a bottom wall at tis lower end;

(b) the button means is operable to move vertically relative to the sleeve means between a raised unlocked position and a relatively lowered locked position; and, (c) the finger means have inwardly turned, integrally formed tip portions that surround and extend radially inwardly toward the upper end region of the operating rod for closely approaching the operating rod and for underlying the bottom wall and obstructing downward movement of the bottom means when the button means is in its raised unlocked position.

9. A control button assembly as set forth in claim 8 wherein the tip portions define pointed edge means for frictionally gripping the shank portion of the button means when the button means is out of its raised unlocked position.

10. A control button assembly as set forth in claim 8 wherein the tip portions define inwardly and upwardly facing cam means for underlying the bottom wall of the stem when the button means is in its raised unlocked position, and for spreading the finger means to permit the shank portion to be frictionally gripped by the tip portions of the finger means when the button means is lowered from its raised unlocked position.

11. The control button assembly of claim 10 wherein the button means and the sleeve means are each individually molded of synthetic resin, and are each one-piece structures.

12. The control button assembly of claim 11 additionally including a toothed washer for press-fitting onto the sleeve means and for engaging portions of the window sill for fastening the sleeve means in the sill opening by press fitting onto the sleeve means at a location beneath the sill.

* * * * *